US006750433B2

(12) United States Patent
Guenther et al.

(10) Patent No.: US 6,750,433 B2
(45) Date of Patent: Jun. 15, 2004

(54) OVEN DISPLAY AND USER INTERFACE

(75) Inventors: Kevin Andrew Guenther, Frederick, MD (US); Tanveer Iqbal, Louisville, KY (US); Cecilia Maria Blanchard, Louisville, KY (US); Brian P. Lenhart, Jr., Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,192

(22) Filed: Nov. 29, 2001

(65) Prior Publication Data

US 2003/0098888 A1 May 29, 2003

(51) Int. Cl.[7] ..... H05B 6/68; H05B 1/02
(52) U.S. Cl. ..... 219/506; 219/490; 219/720
(58) Field of Search ..... 219/506, 720

(56) References Cited

U.S. PATENT DOCUMENTS 4,841,125 A * 6/1989 Edamura ..... 219/506
5,221,817 A * 6/1993 Ota ..... 219/720
5,349,164 A * 9/1994 Ohta ..... 219/506
5,373,142 A * 12/1994 Ohshima et al. ..... 219/506
6,097,016 A * 8/2000 Hirata et al. ..... 219/720
6,486,453 B1 * 11/2002 Bales et al. ..... 219/702
6,528,772 B1 * 3/2003 Graves et al. ..... 219/506
2003/0127451 A1 * 7/2003 Ile ..... 219/506
2003/0150853 A1 * 8/2003 Kung ..... 219/720

* cited by examiner

*Primary Examiner*—Joseph Pelham
(74) *Attorney, Agent, or Firm*—H. Neil Houser, Esq.; Armstrong Teasdale LLP

(57) ABSTRACT

A user interface for an oven including at least one heating element is described. The interface includes a reconfigurable display for indicating a plurality of oven control options and a plurality of selectors adjacent said display for user selection of said options. Each of said selectors correspond to one of said options indicated in said display, and a processor is configured to operate said display in response to manipulation of said plurality of selectors with selection specific menus and to control the heating element according to inputs obtained through said selection specific menus.

24 Claims, 8 Drawing Sheets

OVEN DISPLAY AND USER INTERFACE

BACKGROUND OF INVENTION

This invention relates generally to controls for electric range ovens, and, more particularly, to interactive control displays for oven ranges.

Electronic, touch sensitive, glass control interfaces are becoming increasingly popular in modern range ovens to control a variety of cooking elements, including but not limited to a bake element and a broil element in a cabinet cooking cavity. Known electronic controls have facilitated oven features and modes of baking operation not found in conventional mechanically controlled ranges. Known control interfaces to implement these features, however, tend to be cumbersome and difficult to new users, and tedious and time consuming for other users.

For example, some oven operations and features require rather complex manipulation of a control interface that includes a large number of selectors for a large number of oven options. See, for example, U.S. Pat. No. 6,080,972. These types of interfaces can be overwhelming to new users and less than intuitive even to experienced users. Simplified control interfaces have been developed that are more user friendly and logically operated by prompting user selection of inputs that complete a grammatical instruction sentence. See, for example, U.S. Pat. No. 5,438,180. While effective for relatively simple baking functions, more advanced oven features and options are not easily accommodated by such systems.

SUMMARY OF INVENTION

In one aspect, a user interface for an oven including at least one heating element is provided. The interface comprises a reconfigurable display for indicating a plurality of oven control options and a plurality of selectors adjacent said display for user selection of said options. Each of said selectors correspond to one of said options indicated in said display, and a processor is configured to operate said display in response to manipulation of said plurality of selectors with selection specific menus and to control the heating element according to inputs obtained through said selection specific menus.

In another aspect, a user interface for an oven including at least one baking element is provided. The user interface comprises a processor, a reconfigurable display coupled to said processor, and a plurality of input selectors positioned adjacent said display. The processor is configured to display a HOME menu and selection specific menus in response to operator manipulation of said plurality of input selectors, and also is configured to operate the baking element in response to selected options of said selection specific menus.

In another aspect a user interface for an oven including at least one baking element is provided. The interface comprises a processor configured for coupling to the baking element, a first set of input selectors coupled to said processor, and a first display coupled to said processor, said first display reconfigurable to display selection specific menus in response to user manipulation of said first set of input selectors. A second display is coupled to said processor, and a second set of input selectors is coupled to said processor for entering information into said second display. The processor is configured to display a HOME menu and selection specific menus in said first display in response to operator manipulation of said plurality of input selectors, accept cooking cycle inputs from manipulation of said second set of input selectors, and operate the at least one baking element in response to manipulation of said first and second sets of input selectors.

In another aspect, a method for interfacing user instructions to an oven including a reconfigurable option display, a plurality of input selectors adjacent the option display, and a processor coupled to said display and to said input selectors is provided. The method comprises presenting a HOME menu on said display, presenting one of a plurality of selection specific submenus in response to manipulation of the input selectors, and accepting operator selected control inputs in response to at least some of said selection specific submenus.

In another aspect, a method for controlling operation of an oven including a reconfigurable display, a plurality of input selectors adjacent the display, and a processor coupled to the display and to the input selectors is provided. The method comprises presenting a HOME menu on said display, the HOME menu including a first set of options, and each of said options in the first set adjacent one of the input selectors. The method further comprises presenting a first selection specific submenu in response to manipulation of an input selector adjacent one of the options of the home menu, the first selection specific menu including a second set of options. Each of the options in the second set is adjacent one of the input selectors, and the second set of options is different from said first set of options.

In still another aspect, a method for controlling operation of an oven including a reconfigurable display adapted for multi-column display of option menus, a plurality of input selectors arranged on each side of the display corresponding to one of the menu options, a processor coupled to said display and to said input selectors, and a memory coupled to said processor is provided. The memory is loaded with option menus, cooking parameters and control algorithms, and the method comprises presenting a HOME menu on said display, the HOME menu including a first set of options. A first selection specific submenu is presented in response to manipulation of an input selector adjacent one of the options of the home menu, the first selection specific menu including a second set of options different from said first set of options and including at least a BACK option. A second selection specific submenu is presented in response to manipulation of an input selector adjacent one of the options of the first selection specific submenu, the second selection specific submenu including a third set of options different from said second set of options and including at least a HOME option and a BACK option. Selection specific submenus are repeatedly presented in response to user manipulation of the input selectors, each of the submenus including a HOME option and a BACK option. A cooking algorithm is executed based upon the selected options.

DETAILED DESCRIPTION

Figure 1:
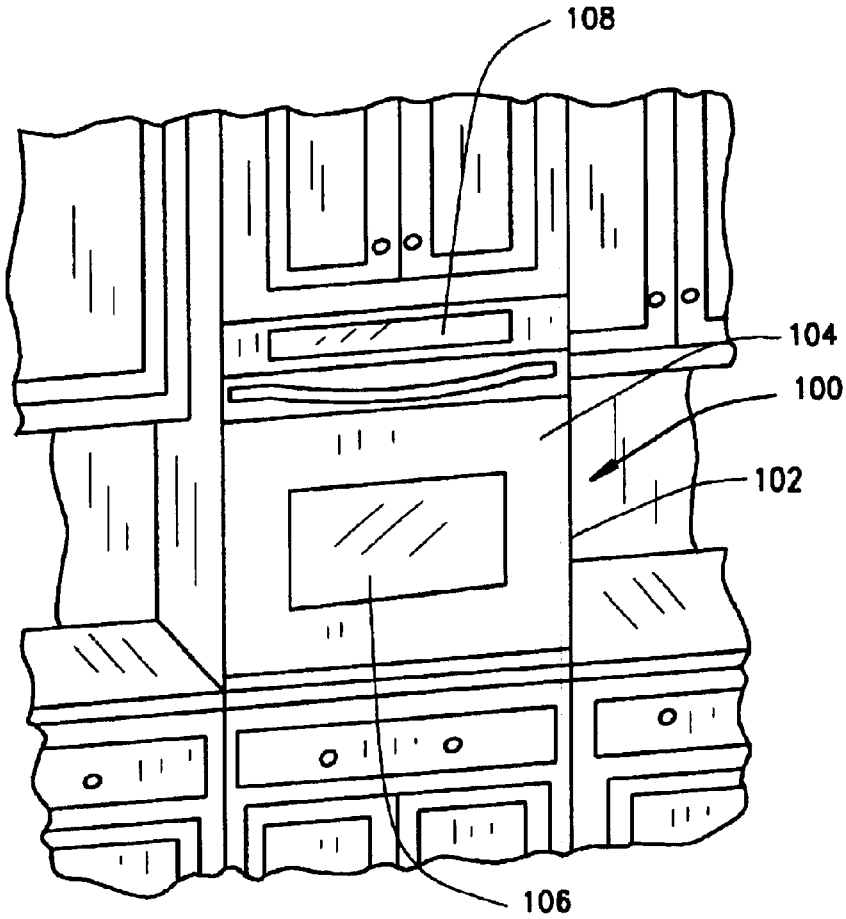
FIG. 1 is front perspective view of a first exemplary oven.

FIG. 1 is front perspective view of a first exemplary oven 100 including a cabinet 102 defining a cooking cavity accessible with a hinged door 104. Oven 100 is sometimes referred to as a single wall oven, and the cooking cavity contains a broil heating element (not shown in FIG. 1) mounted to a ceiling of the cooking cavity, a bake element (not shown in FIG. 1) mounted to a floor of the oven cooking cavity, and a convection bake system including a heating element (not shown) and a fan element fan (not shown in FIG. 1) mounted to a rear wall of the oven cooking cavity. Food is placed on removable oven racks (not shown) within the cooking cavity for heating by the broil element, the baking element or the convection bake system, and the cooking cavity is visible through a window 106 in access door 104.

The oven heating elements are selectively operable by manipulation of an interactive electronic input interface panel 108 and controlled according to methods described below. Oven 100 is operable in a plurality of modes and includes a number of advanced features, including but not limited to timed bake and delayed bake functions for each of the oven heating elements and multi-stage cooking recipes and functions. To facilitate these and other functions, control panel 108 includes a reconfigurable display, described below, and a menu driven input scheme with a manageable number of input selectors.

While the particular embodiment described and illustrated thus far is in the context of a single wall oven, such as oven 100, it is contemplated that the benefits of the invention accrue to other types of ovens and control systems for other types of known oven heating elements, including but not limited to freestanding ovens and ovens including a variety of cooking elements, such as radiant cooking elements, microwave cooking elements, RF cooking elements, gas cooking elements, induction cooking elements, and light cooking elements. In addition, known reflecting elements and the like to focus heat energy in particular portions of the oven cooking cavity may be employed in various embodiments of the invention. Oven 100 is therefore described for illustrative purposes only and not by way of limitation.

Figure 2:
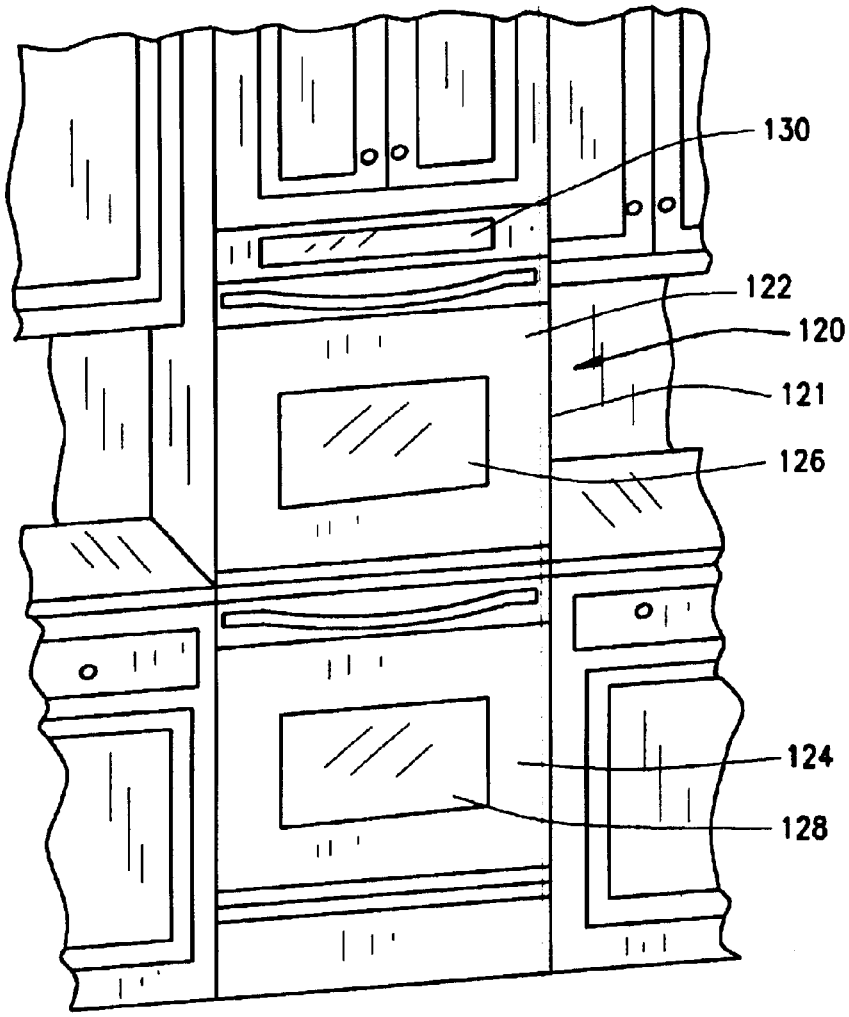
FIG. 2 is a front perspective view of a second exemplary oven.

To further illustrate the advantages of the present invention, FIG. 2 is a front perspective view of a second exemplary oven 120 including a cabinet 121 defining a first cooking cavity accessible with a first hinged door 122, and a second cooking cavity accessible with a second hinged door 124. Oven 120 is sometimes referred to as a double wall oven, and the first cooking cavity is adapted for convention bake cooking, convection roast cooking, and speed cooking using a combination of heating elements while the second cavity is adapted for thermal cooking with known bake and broil heating elements. Of course, it is recognized that in further embodiments the second cavity could be adapted for other types of cooking in addition to or in lieu of thermal cooking using any of the aforementioned heating elements.

Food is placed on removable oven racks (not shown) within the first and/or second cooking cavity for heating by the oven heating elements or convection bake element, and the respective cooking cavities are visible through windows 126, 128 in access doors 122, 124, respectively.

The oven heating elements for the first and second cooking cavities are selectively operable by manipulation of an interactive electronic input interface panel 130 and controlled according to methods described below. Like oven 100 (shown in FIG. 1), oven 120 is operable in a plurality of modes and includes a number of advanced features, including but not limited to timed bake and delayed bake functions for each of the oven heating and baking elements, multi-stage cooking recipes and functions, and the aforementioned speed cooking modes. It is apparent that utilization of multiple heating elements in more than one cooking cavity complicates implementation of these and other features by increasing a number of user options, decisions, and inputs to successfully operate oven 100. Like control panel 108 (shown in FIG. 1) control panel 130 includes a reconfigurable display, described below, and a menu driven input scheme with a manageable number of input selectors.

Figure 3:
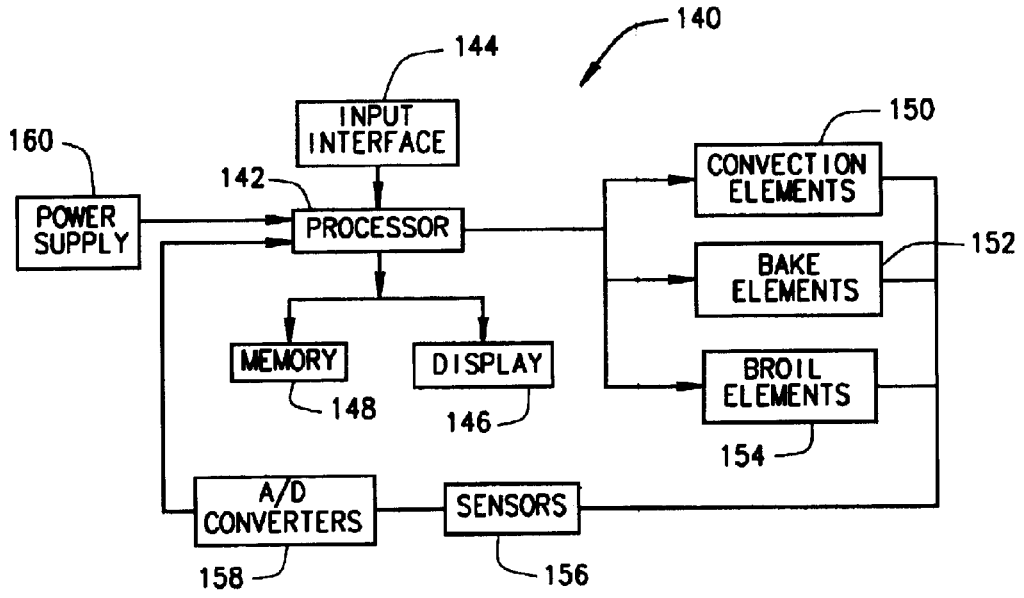
FIG. 3 is a schematic block diagram of the ovens shown in FIGS. 1 and 2.

FIG. 3 is a schematic block diagram of an exemplary oven control system 140 for use with, for example, oven 100 (shown in FIG. 1) or oven 120 (shown in FIG. 2). Control system 140 includes a microprocessor 142 coupled to an input interface 144, which in different embodiments may be either interface 108 (shown in FIG. 1) or interface 130 (shown in FIG. 2).

Microprocessor 142 is further coupled to a reconfigurable display 146 (described below), and a memory 148. Memory 148 includes known RAM modules for storing user inputs, EEPROM elements and/or or ROM memory known in the art for permanent storage of control system data. More specifically, memory 148 is loaded with cooking recipes, cooking algorithms, cooking parameters and data for operating oven heating elements, and a variety of oven option and selection menus, described below, that facilitate user interaction and selection with display 146 and input interface 144. For a given cooking session, microprocessor 142 receives input commands from either input interface 144 or memory 148 and stores the commands in memory 148 or recalls commands from memory 148 for execution of a cooking routine by microprocessor 142.

Microprocessor 142 is operatively coupled to known oven heating elements including convention elements 150, thermal bake elements 152, and broil elements 154 for respective modes of cooking. Elements 150, 152, 154 are operationally responsive to microcprocessor 142 for energization thereof through relays, triacs, or other known mechanisms (not shown) for cycling power to the oven heating elements. One or more temperature sensors or transducers 156 sense operating conditions of oven heating elements 150, 152, 154 and sensors 156 are coupled to an analog to digital converters (A/D converters) 158 to provide a feedback control signal to microprocessor 142. Power is supplied to processor 142 from a power supply 160, and processor 142 cycles power from power supply 160 to oven heating element 150, 152, and 154 to execute cooking algorithms.

In further embodiments, it is contemplated that control system 140 may be adapted for controlling additional oven heating elements beyond those depicted in FIG. 3 without departing from the scope and spirit of the present invention. For example, cooktop surface heating units, radiant cooking elements, microwave cooking elements, RF cooking elements, gas cooking elements, induction cooking elements, and light cooking elements may be controlled according to the control scheme described hereinbelow to implement a wide variety of oven features with a simple, user friendly interface.

Figure 4:
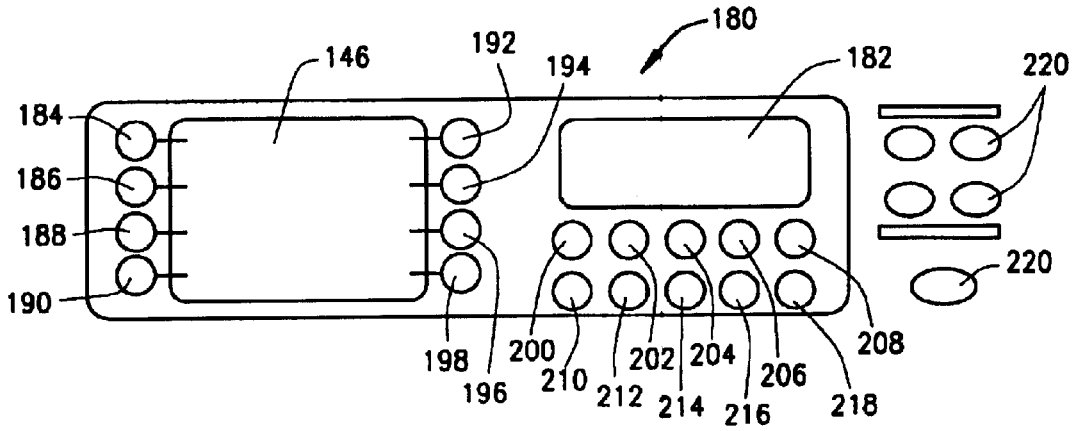
FIG. 4 is a partial plan view of an oven control panel for the ovens shown in FIGS. 1 and 2.

FIG. 4 is a partial plan view of input interface 144 in the form of an oven control interface panel 180 for interactive user selection of instructions for control system 140 (shown in FIG. 3). Control panel 180 includes reconfigurable display 146 and a fixed display 182. A first set of input selectors is associated with reconfigurable display 146 and includes selectors 184, 186, 188 and 190 arranged in a vertical column along a left side of reconfigurable display 146 and also selectors 192, 194, 196, 198 arranged in a vertical column along a right side of display 146. As will become evident below, each selector 184 through 198 corresponds to one of a plurality of options displayed on a menu in display 146, and by manipulating a specific one of selectors 184 through 198, the corresponding menu option is selected.

A second set of input selectors is associated with fixed display 182 and includes selectors 200, 202, 204, 206, 208, 210, 212, 214, 216 and 218 arranged in horizontal rows beneath display 182 for inputting time and temperature inputs into display 182. In an exemplary embodiment, selectors 200 through 218 are keypads consecutively numbered zero through nine for direct numerical input of time and temperature information into display 182. It is contemplated, however, that known slew keypads (e.g., up and down keypads) may be employed to scroll through time and temperature information displayed on display 182 to input time and temperature data to control system 140 (shown in FIG. 3).

Control panel 180 includes a third set of input selectors 220 for operating oven lights, kitchen timers, and lock out features of control panel 180 to prevent inadvertent activation of oven features via casual contact with control panel 180. In exemplary embodiments, input selectors 184 through 220 are integral to a known capacitive glass touch assembly or touch sensitive membrane switch assembly familiar to those in the art. It is appreciated, however, that other known selector mechanisms could be likewise employed while achieving at least some of the advantages of the instant invention. In addition, it is understood that selectors 184 through 220 may be arranged in many alternate configurations relative to displays 146, 182 without departing from the scope of the present invention. It is further recognized that the benefits of the invention equally accrue to control panels having greater or fewer numbers of input selectors than those represented in FIG. 4.

Figure 5:
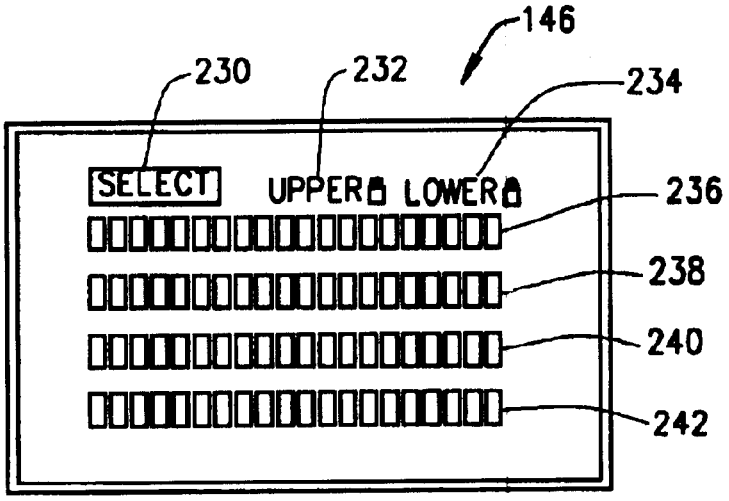
FIG. 5 is a top plan view of a first portion of the control panel shown in FIG. 4.

FIG. 5 is a top plan view of exemplary reconfigurable display 146 including a SELECT indicator 230, an UPPER control lock out indicator 232, a LOWER control lock out indicator 234 and four message lines 236, 238, 240 and 242. As used herein, display 146 is deemed reconfigurable in that message lines 236, 248, 240 and 242 do not have a fixed configuration capable of displaying only a limited number of messages or indicators in designated locations in display 146, but rather are capable of generating a large variety of symbols, alphanumeric characters, and indicia across each line 236, 238, 240, 242 to produce a given display. Additionally, one or more of lines 236, 238, 240 and 242 may be rewritten by processor 142 (shown in FIG. 3) to produce a different display. Thus, unlike known light emitting diode (LED) and certain liquid crystal displays (LCD's) operable to display a limited number of preset indicators in predetermined locations, display 146 is capable of displaying messages and symbols of varying length in any of lines 236 through 242 and at different locations in lines 236 through 242, and then display different messages and symbols in those same locations in lines 236–242. In other words, display 146 is a graphic display screen capable of regenerating multiple and different text and symbol displays. Display screens capable of such image generation are known and include liquid crystal display (LCD), cathode ray tube (CRT), a plasma display, or the like which employ fragmented image generation, such as with pixels.

As will be explained further below, each message line 236, 238, 240, 242 in display 146 extends between a pair of selectors associated with display 146. More specifically, message line 236 extends between input selectors 184 and 192 (shown in FIG. 4), message line 238 extends between input selectors 186 and 194 (shown in FIG. 4), message line 240 extends between input selectors 188 and 196 (shown in FIG. 4) and message line 242 extends between input selectors 190 and 198 (shown in FIG. 4). Thus, each message line extends between two input selectors, and when an oven option is displayed in a given line adjacent one of the selectors, manipulating the input selector next to the option selects that option, which should become apparent in light of the examples set forth below.

Figure 6:
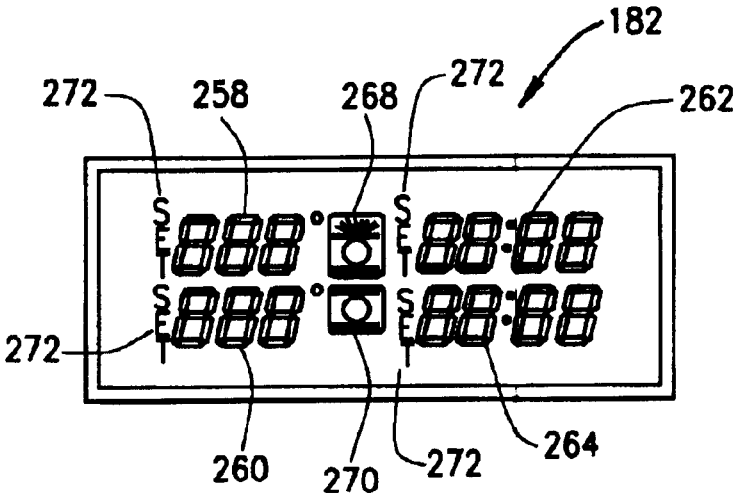
FIG. 6 is a top plan view of a second portion of the control panel shown in FIG. 4.

FIG. 6 is a top plan view of fixed display 182 (shown in FIG. 4). In an exemplary embodiment, display 182 is an LED display including a first temperature indicating region 258, a second temperature indicating region 260, a first time indicating region 262, a second time indicating region 264, an upper oven mode indicator 268, a lower oven mode indicator 270, and a plurality of SET indicators 272 for the various display regions 258, 260, 262, 264. In contrast to display 146 (shown in FIGS. 4 and 5) display 182 is not reconfigurable due to its ability to convey limited, preset information only in specific, designated locations. Oven mode indicators 268, 270 are selectively illuminated in discrete portions according to the actual mode of operation (e.g., thermal cooking, broil cooking, convention cooking, etc.) of each of the respective ovens. It is appreciated that in a single wall oven, such as oven 100 (shown in FIG. 1), the second mode indicator 272 is not employed.

Input selectors 200 through 218 (shown in FIG. 4) are employed to input time and temperature data into fields 258, 260, 262 and 264 at appropriate places in a menu sequence displayed on display 146 (shown in FIGS. 4 and 5). Time and temperature data is used by microprocessor 142 (shown in FIG. 3) to implement a cooking algorithm based on the input data. Time indicating region 262, in an exemplary embodiment, displays the time of day when the associated oven, such as oven 100 (shown in FIG. 1) or oven 120 (shown in FIG. 2) is not in use. Indicators 272 are also illuminated at appropriate times in oven operation to direct user input of time and temperature data, as partly pointed out and partly apparent from the description below.

Figure 7:
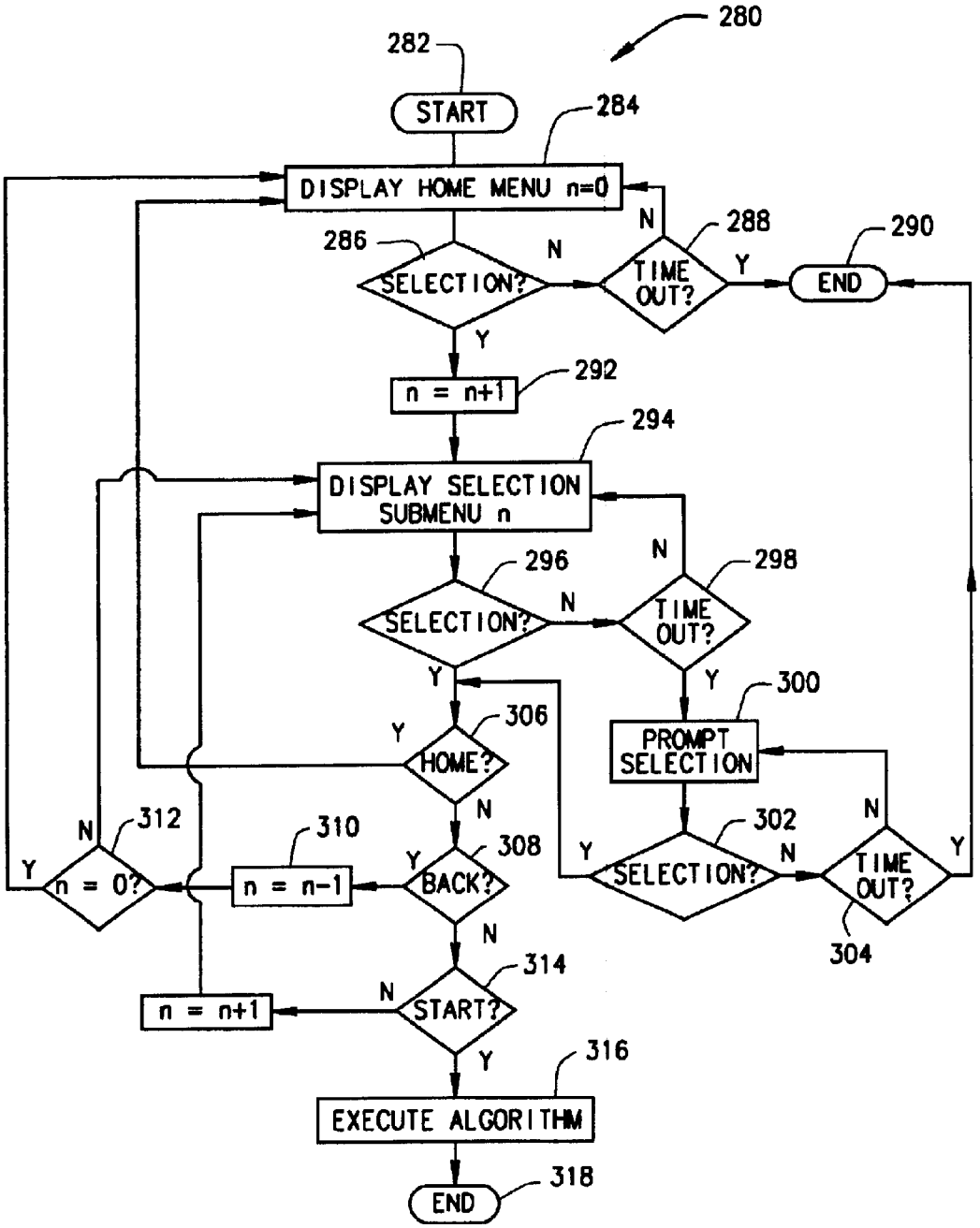
FIG. 7 is method flowchart of a control scheme for the control panel shown in FIGS. 4–6.

FIG. 7 illustrates an exemplary method 280 flowchart of a control scheme for exemplary control panel 180 (shown in FIG. 4). Method 280 is executable by control system 140 (shown in FIG. 3) and more specifically is implemented by microprocessor 142 (shown in FIG. 3) to provide a straightforward user interface for exemplary oven 100 (shown in FIG. 1) and oven 120 (shown in FIG. 2).

Method 280 begins 282 by displaying 284 a HOME menu on reconfigurable display 146 (shown in FIGS. 4–5). As will be more evident in the example menu sequences below, the HOME menu includes high-level oven options and is the default screen or display when microprocessor 142 is powered up or when one of input selectors 184 through 198 is activated when the oven is in a dormant or inactive state of nonuse. For purposes of description, the HOME option menu corresponds to a menu counter value n of zero. In one embodiment, the HOME menu includes eight options, and more specifically, two options in each of the four message lines 236, 238, 240 and 242 (shown in FIG. 5) of display 146. The HOME menu options are located in each message line adjacent one of input selectors 184 through 198 (shown in FIG. 4). One of the HOME menu options may be selected by activating the appropriate input selector (e.g., depressing the touch sensitive input selector) adjacent the desired option in the HOME menu.

Microprocessor 142 waits 286 for a user selection from the HOME menu, i.e., whether one of input selectors 184 through 198 has been activated. In one embodiment, a timer is set by microprocessor 142 and microprocessor 142 compares 288 an elapsed time from the timer to a predetermined maximum time, sometimes referred to as a TIME OUT period. If the TIME OUT period has been exceeded without a user selection from the HOME menu, method 280 ends 290 and display 146 is deactivated. When one of input selectors 184–198 is again activated while display 146 is deactivated, method 280 restarts 282. If the TIME OUT period has not been exceeded and a user has not made a selection from the HOME menu, the HOME menu remains displayed 284 and microprocessor 142 continues to wait for a selection of one of the HOME menu options.

If a user selection is made from the HOME menu, the menu counter n is incremented 292 and a submenu is displayed 294 that is specific to the option selected from the HOME menu. For instance if, for example, the HOME option menu includes a FEATURES option that is selected, display 146 is reconfigured and a submenu is displayed 294 that provides more options to obtain information on oven features. In one embodiment, the submenu displayed 294 includes a menu title corresponding to the specific option selection from the HOME menu, and up to seven additional menu options for user selection that are more focused toward a specific objective according to the option selected from the HOME menu. In other words, the selection specific submenu displayed 294 is a lower-level option menu than the HOME menu, and in an exemplary embodiment, the submenu displayed 294 includes options such as a HOME option, a BACK option, and a HELP option to assist user navigation of oven option menus.

After submenu n is displayed 294, microprocessor 142 waits 296 for a user selection from the selection specific submenu n. In other words, microprocessor waits 296 for one of input selectors 184 through 198 to be activated in response to submenu n. A timer is set by microprocessor 142 and microprocessor 142 compares 298 an elapsed time from the timer to a predetermined TIME OUT period. If the TIME OUT period has been exceeded without a user selection from the submenu n, microprocessor prompts 300 a user selection, such as by flashing one of the options on submenu n or with an audio indicator. After prompting 300 a user selection, microprocessor 142 again waits 302 for a selection and a timer is again set by microprocessor 142 that is compared 304 to a predetermined TIME OUT period, such as 30 seconds in an exemplary embodiment. If no selection is made within the TIME OUT period, method 280 ends 290 and display 146 is deactivated. When one of input selectors 184–198 is again activated while display 246 is deactivated, method 280 restarts 282.

If the TIME OUT period has not been exceeded and a user has not made a selection from the submenu n, microprocessor 142 continues to prompt 300 user selection and continues to wait 302 for a selection of one of the options on submenu n.

If a selection is made from submenu n within the TIME OUT period, microprocessor 142 reconfigures display 146 in response to the selected option.

If the HOME option is selected 306 from submenu n, microprocessor 142 returns to display 284 the HOME menu and menu counter n is reset to zero.

If the BACK option is selected 308 from submenu n, n is decremented 310, and if the decremented n equals zero 312, microprocessor 142 returns to display 284 the HOME menu. If n does not equal zero, microprocessor returns to display 294 submenu n. It is recognized that in the first submenu presented the BACK option and the HOME option will accomplish the same result, but in deeper submenus, the BACK option will return to the previous option menu displayed, while the HOME option returns to the HOME menu.

If submenu n includes a START option that has been selected 314, microprocessor 142 executes 316 a cooking algorithm or oven operation corresponding to the selected option. When the algorithm is executed and completed, method 280 ends 318 and display 246 is deactivated. When one of input selectors 184–198 is again activated while display 246 is deactivated, method 280 restarts 282.

If the selected option from submenu n is other than the HOME option, the BACK option, or a START option, menu counter n is incremented and a selection specific submenu n corresponding to the selected option is displayed 294.

From the foregoing description, it should be apparent that the above described process is iterative until a START option is selected in one of the submenus. Thus, a plurality of layered menus presented in submenu form in response to particular options selected from each menu, rather easily guides a user through complicated series of instructions and inputs to execute oven features and options, while providing BACK, HOME, and HELP options to assist user navigation of the menus. A wide variety of oven features and a wealth of oven information are therefore implemented with relatively few input selectors 184 though 198 and a user friendly interface that is less likely to intimidate users than known electronic touch sensitive control systems.

In a further aspect, utilizing the above-described control scheme, much of the information contained in user manuals may now be accessible through display 146 and input selectors 184 through 198. Thus, user checklists for various operations, such as speed cooking modes and self cleaning modes, troubleshooting information and details on fault codes that may be encountered in oven operation, service information, and oven specific information, such as model numbers and serial numbers, are facilitated through the HOME menu options and the many submenu options embedded in the HOME menu options. Microprocessor 142 and display 146 walk the user through information and steps required to operate the oven, and prompt user inputs when necessary.

In still a further aspect, when control system 140 (shown in FIG. 3) is connected to the Internet according to known techniques, display 146 may be utilized as a browser to retrieve and download oven recipes, information and control updates.

Having now described the system generally, the benefits of the invention are hoped to be apparent and the above described methodology amply demonstrated from the following exemplary menu sequences generated in response to operator selection of specific oven features in an exemplary embodiment. While it is anticipated that the following menu sequences provide some insight as to the behavior of the control system and interface, it is emphasized that the following examples are offered for illustrative purposes only, and that specific option menus may vary considerably in alternative embodiments without departing from the scope of the present invention.

Figure 8:
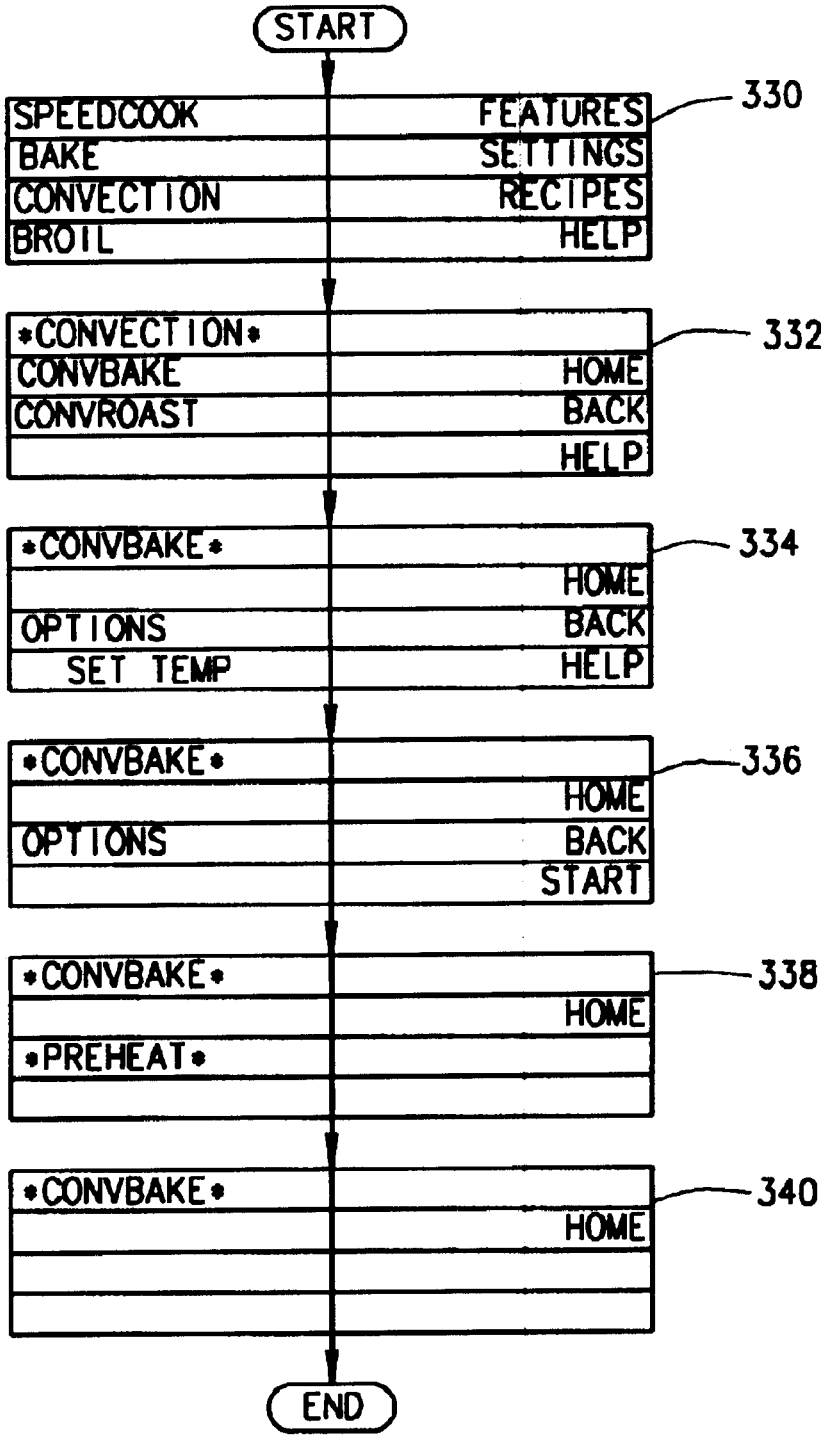
FIG. 8 is a first exemplary menu sequence according to the method illustrated in FIG. 7.

Referring now to FIG. 8, in an exemplary embodiment, a HOME menu is displayed 330 that includes eight menu options arranged in two columns in display 146 (shown in FIGS. 4 and 5) within display message lines 236 through 242 (shown in FIG. 5). More specifically, a first column of options for the HOME menu includes a SPEEDCOOK option corresponding to input selector 184 (shown in FIG. 4), a BAKE option corresponding to input selector 186 (shown in FIG. 4), a CONVECTION option corresponding to input selector 188 (shown in FIG. 4) and a BROIL option corresponding to input selector 190 (shown in FIG. 4). A second column of options includes a FEATURES option corresponding to input selector 192 (shown in FIG. 4), a SETTINGS option corresponding to input selector 194 (shown in FIG. 4), a RECIPES option corresponding to input selector 196 (shown in FIG. 4), and a HELP option corresponding to input selector 198 (shown in FIG. 4).

Any of the input selectors 184 through 198 may be manipulated to select any of the selection options in the HOME menu and a selection specific submenu will be presented for the selected option. For purposes of this example, suppose that input selector 188 is activated by a user to select the CONVECTION option.

Once the CONVECTION option is selected, display 146 is reconfigured and a submenu is presented 332 specific to the CONVECTION feature selected. *CONVECTION* is displayed as the submenu title adjacent input selector 184, and five menu options are presented in message lines 238, 240, and 242 of display 146. More specifically, a CONVBAKE (convention bake) option is presented adjacent input selector 186 (shown in FIG. 4), a CONVROAST (convection roast) option is presented adjacent input selector 188 (shown in FIG. 4), a HOME option is presented adjacent input selector 194 (shown in FIG. 4), a BACK option is presented adjacent input selector 196 (shown in FIG. 4), and a HELP option is presented adjacent input selector 198 (shown in FIG. 4). In this particular example, no submenu options are presented adjacent input selectors 190 and 192 in display 146.

Any of the input selectors 184 through 198 may be manipulated to select any of the selection options in the CONVECTION menu 332 and display 146 will be reconfigured accordingly. Continuing with the present example, suppose that input selector 186 is activated by a user to select the CONVBAKE option from the CONVENTION menu 332.

Once the CONVBAKE option is selected, display 146 is reconfigured and a submenu is presented 334 specific to the CONVBAKE feature selected. *CONVBAKE* is displayed as the submenu title adjacent input selector 184, and five menu options are presented in message lines 238, 240, and 242 of display 146. More specifically, an OPTIONS option is presented adjacent input selector 188 (shown in FIG. 4), a SET TEMP instruction is presented adjacent input selector 190 (shown in FIG. 4), a HOME option is presented adjacent input selector 194 (shown in FIG. 4), a BACK option is presented adjacent input selector 196 (shown in FIG. 4), and a HELP option is presented adjacent input selector 198 (shown in FIG. 4). In this particular submenu, no options are presented adjacent input selectors 186 and 192 in display 146.

Any of the input selectors 184 through 198 may be manipulated to select any of the selection options in the CONVBAKE menu 332 and display 146 will be reconfigured accordingly. For example, selecting the HOME option will return to menu 330 and selecting the BACK option will return to menu 332. Continuing with the present example, assuming that no other option is selected, microprocessor 142 waits for user input of temperature, 350° for example, using input selectors 200 through 218 and display 182 (shown in FIG. 4). Each digit input is displayed in display 182 (shown in FIGS. 4 and 6) and when the third temperature digit is entered, display 146 is reconfigured and a new menu is presented 336. Menu 336 is similar to the previous menu 334 but omitting the SET TEMP option and replacing the HELP option in menu 334 with a START option next to input selector 198 (shown in FIG. 4). If no further menu selection is made within a TIME OUT period of 30 seconds, the START option flashes to prompt the user to START the selected convention bake option at a temperature of 350°. Selecting the OPTIONS menu displays yet another menu (not shown) including TIMED BAKE and DELAYED BAKE options, among others.

Once the START option is selected from menu 336, another menu is presented 338 including the *CONVBAKE* title, a *PREHEAT* message in message line 240 (shown in FIG. 5), and the HOME option. Microprocessor 142 begins a preheat function, and when the oven is preheated, another menu is presented 340 with the *PREHEAT* message absent from the display. Display 146 continues to display menu 340 unless the user selects the HOME option, in which case display 146 returns to the HOME menu 330. The selected temperature is displayed in display 182 (shown in FIGS. 4 and 6).

Figure 9:
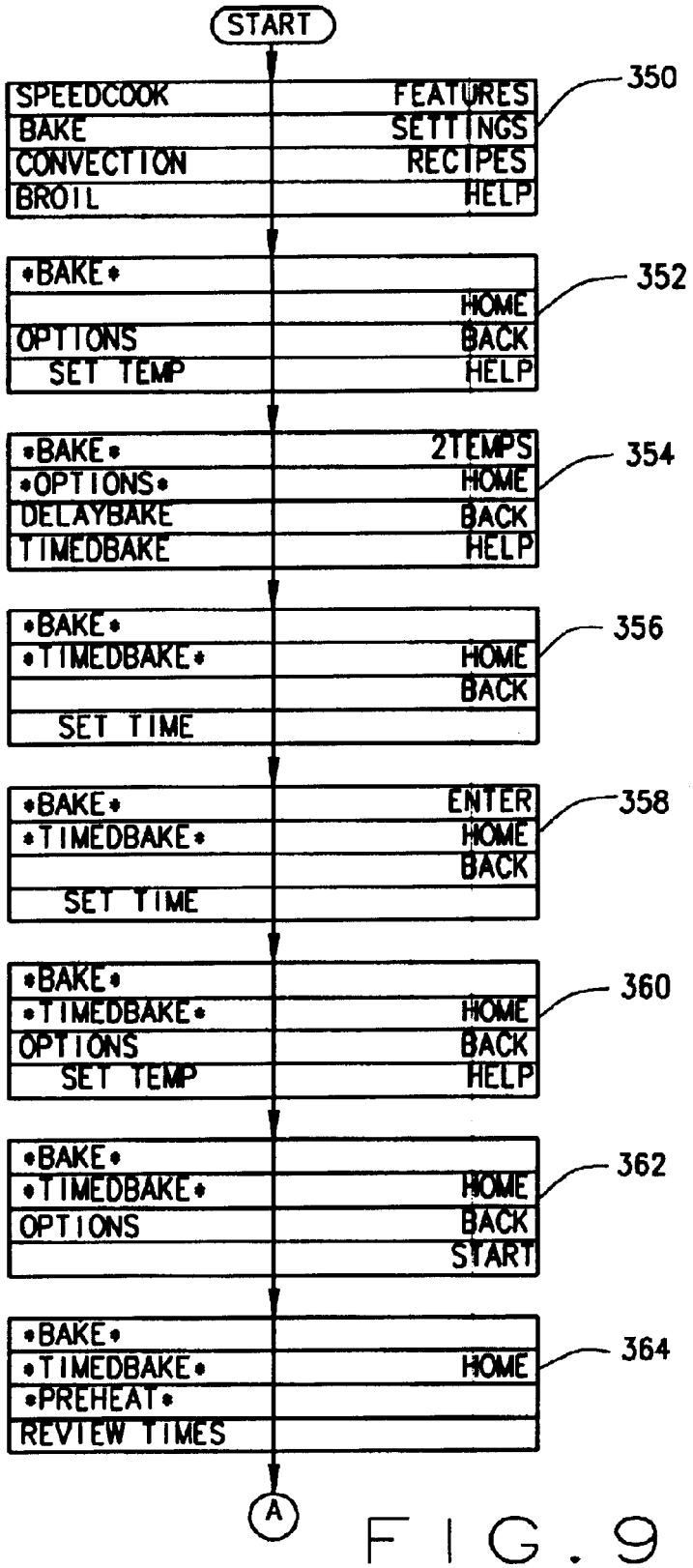
FIG. 9 is a first portion of a second exemplary menu sequence according to the method illustrated in FIG. 7.
Figure 10:
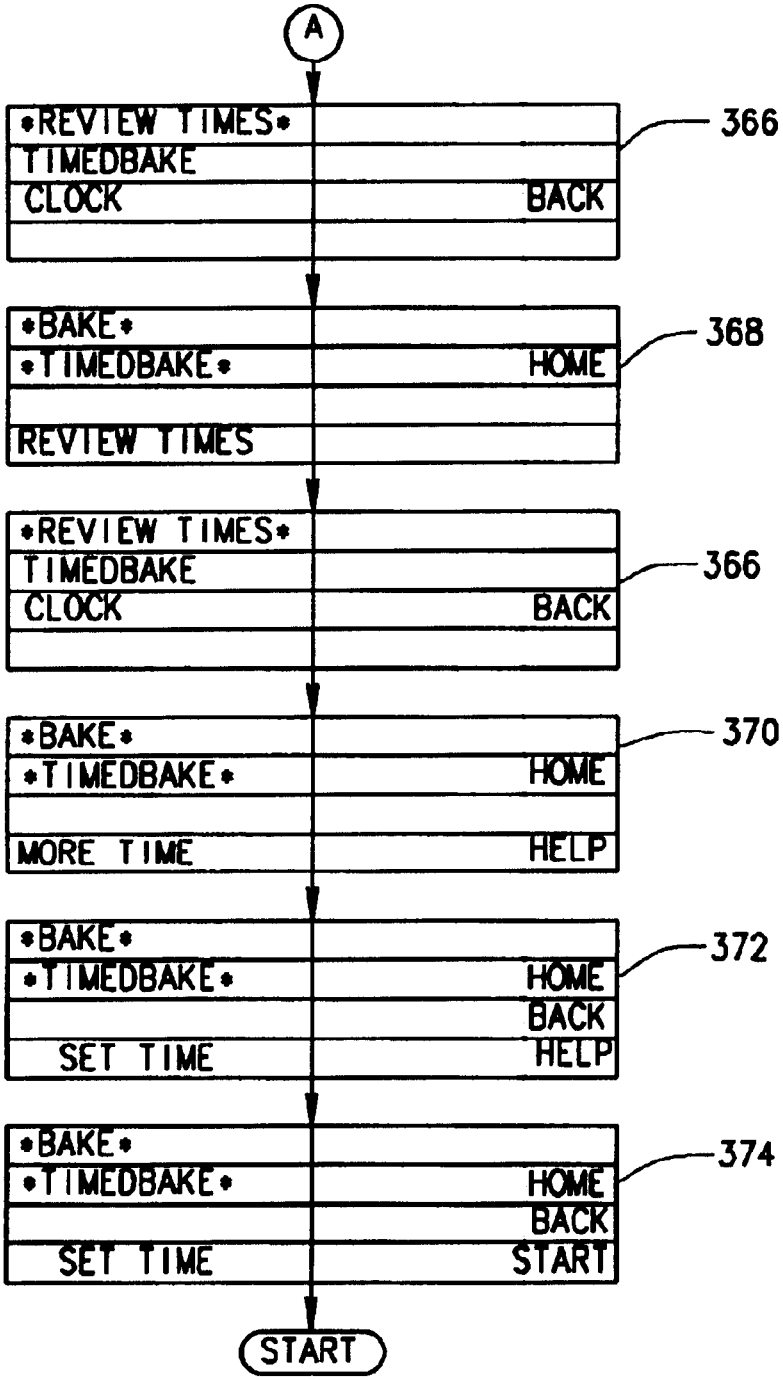
FIG. 10 is a second portion of the exemplary menu sequence shown in FIG. 9.

Referring now to FIGS. 9 and 10 a more complicated oven feature sequence is presented that perhaps better demonstrates the advantages of the layered menu and submenu system of the present invention.

Similar to the example shown in FIG. 8, a HOME menu is displayed 350 that includes eight menu options arranged in two columns in display 146 (shown in FIGS. 4 and 5) within display message lines 236 through 242 (shown in FIG. 5). More specifically, a first column of options for the HOME menu includes a SPEEDCOOK option corresponding to input selector 184 (shown in FIG. 4), a BAKE option corresponding to input selector 186 (shown in FIG. 4), a CONVECTION option corresponding to input selector 188 (shown in FIG. 4) and a BROIL option corresponding to input selector 190 (shown in FIG. 4). A second column of options includes a FEATURES option corresponding to input selector 192 (shown in FIG. 4), a SETTINGS option corresponding to input selector 194 (shown in FIG. 4), a RECIPES option corresponding to input selector 196 (shown in FIG. 4), and a HELP option corresponding to input selector 198 (shown in FIG. 4).

Any of the input selectors 184 through 198 may be manipulated to select any of the selection options in the HOME menu and a selection specific submenu will be presented for the selected option. For purposes of this example, suppose that input selector 186 is activated by a user to select the BAKE option.

Once the BAKE option is selected, display 146 is reconfigured and a submenu is presented 352 specific to the BAKE feature selected. *BAKE* is displayed as the submenu title adjacent input selector 184, and five menu options are presented in message lines 238, 240, and 242 of display 146. More specifically, an OPTIONS option is presented adjacent input selector 188 (shown in FIG. 4), a SET TEMP instruction is presented adjacent input selector 190 (shown in FIG. 4), a HOME option is presented adjacent input selector 194 (shown in FIG. 4), a BACK option is presented adjacent input selector 196 (shown in FIG. 4), and a HELP option is presented adjacent input selector 198 (shown in FIG. 4). In this particular submenu, no options are presented adjacent input selectors 186 and 192 in display 146.

Any of the input selectors 184 through 198 may be manipulated to select any of the selection options in the BAKE menu 352 display 146 will be reconfigured accordingly. Continuing with the instant example, suppose that input selector 188 is activated by a user to select the OPTIONS option from the BAKE menu 352.

Once the OPTIONS option is selected, display 146 is reconfigured and a submenu is presented 354 specific to the BAKE and OPTIONS features that have been selected. *BAKE* is displayed as the submenu title adjacent input selector 184 and *OPTIONS* is displayed as a sub-submenu title adjacent input selector 186 (shown in FIG. 4), thereby clearly indicating the menu sequence to a user. Menu 354 further includes six menu options in message lines 238, 240, and 242 of display 146. More specifically, an DELAY BAKE option is presented adjacent input selector 188 (shown in FIG. 4), a TIMEDEBAKE option is presented adjacent input selector 190 (shown in FIG. 4), a 2TEMPS option (for a multi-stage cooking recipe) is presented adjacent input selector 192, a HOME option is presented adjacent input selector 194 (shown in FIG. 4), a BACK option is presented adjacent input selector 196 (shown in FIG. 4), and a HELP option is presented adjacent input selector 198 (shown in FIG. 4).

Any of the input selectors 184 through 198 may be manipulated to select any of the selection options in BAKE and OPTIONS menu 354, and display 146 will be reconfigured accordingly. For example, selecting the HOME option will return to menu 350 and selecting the BACK option will return to menu 352. Continuing with the instant example, however, suppose that input selector 190 is activated by a user to select the TIMEDBAKE option from menu 354.

When the TIMED BAKE option is selected, display 146 is reconfigured and a new submenu is presented 356. *BAKE* is displayed as the submenu title adjacent input selector 184 and *TIMEDBAKE* is displayed as a sub-submenu title adjacent input selector 186 (shown in FIG. 4), thereby clearly indicating the selected menu sequence to a user. Menu 356 includes a SET TIME instruction presented adjacent input selector 190 (shown in FIG. 4), a HOME option presented adjacent input selector 194 (shown in FIG. 4), and a BACK option presented adjacent input selector 196 (shown in FIG. 4).

Following the instant example, assuming no other option is selected, microprocessor 142 waits for user input of a cooking time, 30 minutes for example, using input selectors 200 through 218 and display 182 (shown in FIG. 4). Each cooking time digit input is displayed in display 182 (shown in FIGS. 4 and 6) and when the first temperature digit is entered, display 146 is reconfigured and a new menu is presented 358. Menu 358 is similar to the previous menu 356 but including an ENTER option adjacent input selector 192 (shown in FIG. 4). After a predetermined TIME OUT period of 30 seconds, the ENTER option flashes to prompt the user to input a selected cook time.

Once a cooking time is input and the user selects the ENTER option, display 146 is reconfigured and another submenu is presented 360. *BAKE* is displayed as the submenu title adjacent input selector 184 and *TIMEDBAKE* is displayed as a sub-submenu title adjacent input selector 186 (shown in FIG. 4), thereby clearly indicating the selected menu sequence to a user. Menu 360 includes an OPTIONS option adjacent input selector 188 (shown in FIG. 4), a SET TEMP instruction is presented adjacent input selector 190 (shown in FIG. 4), a HOME option presented adjacent input selector 194 (shown in FIG. 4), a BACK option presented adjacent input selector 196 (shown in FIG. 4) and a HELP option presented adjacent input selector 198 (shown in FIG. 4). Following the instant example, the SET TEMP option is selected by a user.

When SET TEMP is selected, microprocessor 142 waits for user input of temperature, 350° for example, using input selectors 200 through 218 and display 182 (shown in FIG. 4). Each digit input is displayed in display 182 (shown in FIGS. 4 and 6) and when the third temperature digit (zero in this example) is entered, display 146 is reconfigured and a new menu is presented 362. Menu 362 is similar to the previous menu 360 but omitting the SET TEMP option and replacing the HELP option in menu 360 with a START option next to input selector 198 (shown in FIG. 4). If no further menu selection is made within a TIME OUT period of 30 seconds, the START option flashes to prompt the user to START the selected bake option at a temperature of 350°.

Once the START option is selected from menu 362, another menu is presented 364 including the *BAKE* title, the *TIMEDBAKE* subtitle, a *PREHEAT* message in message line 240 (shown in FIG. 5), the HOME option, and a REVIEW TIMES option. Microprocessor 142 begins a preheat function, and when the oven is preheated the *PREHEAT* message disappears from the display.

When the REVIEW TIMES option is selected, a REVIEW TIMES submenu is presented 366 including a *REVIEW TIMES* title, a TIMEDBAKE option, a CLOCK option, and a BACK option. When the TIMEDBAKE option is selected, the cooking time is displayed on display 182 (shown in FIG. 4). When the CLOCK option is selected, the time of day is displayed on display 182. Thus, the oven user can toggle between a cooking timer and the present time of day with menu 366. When finished toggling between these times, selecting the BACK button results in another menu being presented 368, which the reader may recognize as menu 366 with the *PREHEAT* message disabled. It is recognized, however, that the preheat function is independent of the REVIEW TIMES option and therefore that the *PREHEAT* message would continue to appear until oven preheating is completed.

If the REVIEW TIMES option is again selected, menu 366 is again presented. Display 146 continues to display menu 366 unless the user selects the HOME option, in which case display 146 returns to the HOME menu 330. The selected temperature is displayed in display 182 (shown in FIGS. 4 and 6).

When the input cooking time is decremented to zero, baking functions are suspended to allow a user to check the food, and a new menu 370 is presented including a MORE TIME option and a HELP option in addition to the HOME option.

When the MORE TIME option is selected to further cook the food, another menu is presented 372 that is similar to menu 356 but also including a HELP option. Microprocessor 142 then waits for user input of an additional cooking time using input selectors 200 through 218 and display 182 (shown in FIG. 4). Each cooking time digit input is displayed in display 182 (shown in FIGS. 4 and 6) and when the first temperature digit (zero in this example) is entered, display 146 is reconfigured and a new menu is presented 374 including a START option. After a predetermined TIME OUT period of 30 seconds, the START option flashes to prompt the user to input a selected cook time.

When the START option is selected, microprocessor accepts the input instructions entered by the user through control interface 180 and executes a cooking algorithm in accordance with the user-selected instructions.

It is believed that programming of a multi-layered menu system such as those described above is within the purview of those in the art, and detailed computer listings or code of a software architecture for such a system are therefore omitted.

In addition, while it is believed that the above described system, method, and exemplary menu sequences fully demonstrate the benefits of the invention in providing a user friendly control interface for implementing advanced control features and oven options, it is recognized that many additional features beyond those described specifically herein may be accommodated by the system and methodology described herein with a relatively small number of input selectors. It is believed that the interface system of the present invention is intuitive and largely self evident to oven users at various skill levels. Consequently, it is submitted that, unlike known electronically controlled ovens having advanced features, the oven could be used with almost no introduction to the system and without having to read a user's manual. For at least these reasons, the oven of the present invention is believed to more desirable to manufacturers and consumers alike in comparison to conventional electronic oven control systems.

While the invention has been described in terms of various specific embodiments, those skilled in the art will recognize that the invention can be practiced with modification within the spirit and scope of the claims.

What is claimed is:

1. A user interface for an oven including at least one heating element, said interface comprising:

a reconfigurable display for indicating a plurality of oven control options;

a plurality of selectors adjacent said display for user selection of said options, each of said selectors corresponding to one of said options indicated in said display; and a processor configured to operate said display in response to manipulation of said plurality of selectors with selection specific menus and to control the heating element according to inputs obtained through said selection specific menus, said processor configured to display selection specific menus comprising at least one of a HOME option or a BACK option.

2. A user interface in accordance with claim 1 wherein said processor is further configured to operate said display to present a checklist for various modes of operation of the oven.

3. A user interface in accordance with claim 1 wherein said processor is further configured to operate said display to provide troubleshooting information for operation of the oven.

4. A user interface in accordance with claim 1 configured to be connected to the Internet, and wherein said reconfigurable display is operable as a browser to retrieve and download oven recipes, information, and control updates.

5. A user interface in accordance with claim 1, said processor configured to display selection specific menus comprising a HELP option.

6. A user interface in accordance with claim 5, said processor configured to display each said selection specific menu with a menu title.

7. A user interface in accordance with claim 1, said menus comprising first and second columns of oven control selections, and a selector adjacent each of said selections in said menu for selecting a respective one of said selections from said menus.

8. A user interface in accordance with claim 1 further comprising a time and temperature display separate from said reconfigurable display.

9. A user interface for an oven including at least one baking element, said user interface comprising:

a processor;

a reconfigurable display coupled to said processor; and a plurality of input selectors positioned adjacent said display, said processor configured to display a HOME menu and selection specific menus in response to operator manipulation of said plurality of input selectors, to operate the baking element in response to selected options from said selection specific menus, and to display at least a BACK option in each of said selection specific menus.

10. A user interface in accordance with claim 9, each of said HOME menu and selection specific menus arranged in a multi-column format.

11. A user interface in accordance with claim 10, said columns comprising a plurality of selection options, said input selectors arranged adjacent each said column such that each input selector corresponds to a selection in said column.

12. A user interface in accordance with claim 11, said interface further comprising a time and temperature display separate from said reconfigurable display.

13. A user interface for an oven including at least one baking element, said interface comprising:

a processor configured for coupling to the baking element;

a first set of input selectors coupled to said processor;

a first display coupled to said processor, said first display reconfigurable to display selection specific menus in response to user manipulation of said first set of input selectors;

a second display coupled to said processor;

a second set of input selectors coupled to said processor for entering information into said second display; and said processor configured to:

display a HOME menu and selection specific menus in said first display in response to operator manipulation of said plurality of input selectors;

accept cooking cycle inputs from manipulation of said second set of input selectors;

operate the at least one baking element in response to manipulation of said first and second sets of input selectors; and display at least a HOME option in each of said selection specific menus.

14. A user interface in accordance with claim 13, said processor configured to display multi-column menus of oven options in said reconfigurable display.

15. A user interface ion accordance with claim 14, said first set of input selectors comprising a first column of input selectors adjacent one side of said first display, and a second column of input selectors adjacent an opposite side of said first display.

16. A user interface in accordance with claim 14, said second set of input selectors comprising ten selectors numbered 0–9.

17. A method for interfacing user instructions to an oven including a reconfigurable option display, a plurality of input selectors adjacent the option display, and a processor coupled to said display and to said input selectors, said method comprising:

presenting a HOME menu on said display;

presenting one of a plurality of selection specific submenus in response to manipulation of the input selectors;

accepting operator selected control inputs in response to at least some of said selection specific submenus; and wherein presenting a selection specific submenu comprises presenting at least one option selected from the group consisting of HOME and BACK.

18. A method in accordance with claim 17 further comprising prompting a user selection within a submenu when no selection has been made within a predetermined time period.

19. A method in accordance with claim 18 further comprising disabling said menu if no selection is made within a predetermined period of time.

20. A method in accordance with claim 17 wherein accepting operator selected control inputs comprises accepting a cooking time input and a cooking temperature input.

21. A method for controlling operation of an oven including a reconfigurable display, a plurality of input selectors adjacent the display, and a processor coupled to the display and to the input selectors, said method comprising:

presenting a HOME menu on said display, the HOME menu including a first set of options; each of said options in the first set adjacent one of the input selectors;

presenting a first selection specific submenu in response to manipulation of an input selector adjacent one of the options of the home menu, the first selection specific menu including a second set of options, each of the options in the second set adjacent one of the input selectors, the second set of options different from said first set of options, and said second set of options comprising at least a BACK option and a HOME option.

22. A method in accordance with claim 21 further comprising presenting a second selection specific submenu in response to manipulation of an input selector adjacent one of the options of the first selection specific submenu, the second selection specific submenu including a third set of options, each of the options in the third set adjacent one of the input selectors, said third set of options different from said second set of options, and said third set of options comprising at least a BACK option and a HOME option.

23. A method in accordance with claim 22 further comprising prompting a user selection when a selection is not made within a predetermined time period.

24. A method for controlling operation of an oven including a reconfigurable display adapted for multi-column display of option menus, a plurality of input selectors arranged on each side of the display corresponding to one of the menu options, a processor coupled to said display and to said input selectors, and a memory coupled to said processor, the memory loaded with option menus, cooking parameters and control algorithms, said method comprising:

presenting a home menu on said display, the home menu including a first set of options;

presenting a first selection specific submenu in response to manipulation of an input selector adjacent one of the options of the home menu., the first selection specific menu including a second set of options, the second set of options different from said first set of options and including at least a BACK OPTION; and presenting a second selection specific submenu in response to manipulation of an input selector adjacent one of the options of the first selection specific submenu, the second selection specific submenu including a third set of options, said third set of options different from said second set of options and including at least a HOME option and a BACK option;

repeatedly presenting selection specific submenus in response to user manipulation of the input selectors, each of the submenus including a HOME option and a BACK option; and executing a cooking algorithm based upon the selected options.

* * * * *